US011616327B2

(12) United States Patent
Patel

(10) Patent No.: US 11,616,327 B2
(45) Date of Patent: Mar. 28, 2023

(54) CONTACT ASSEMBLY WITH GROUND STRUCTURE

(71) Applicant: TE Connectivity Services GmbH, Schaffhausen (CH)

(72) Inventor: Sandeep Patel, Littleton, CO (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 74 days.

(21) Appl. No.: 17/208,318

(22) Filed: Mar. 22, 2021

(65) Prior Publication Data

US 2022/0302652 A1 Sep. 22, 2022

(51) Int. Cl.

| | |
|---|---|
| ***H01R 12/72*** | (2011.01) |
| ***H01R 13/6585*** | (2011.01) |
| ***H01R 13/6596*** | (2011.01) |
| ***H01R 13/405*** | (2006.01) |

(52) U.S. Cl.

CPC ..... *H01R 13/6585* (2013.01); *H01R 12/721* (2013.01); *H01R 13/405* (2013.01); *H01R 13/6596* (2013.01)

(58) Field of Classification Search

CPC ..... H01R 13/6471; H01R 13/65914; H01R 13/6592; H01R 13/6585; H01R 13/6581; H01R 24/60; H01R 12/53; H01R 13/6593; H01R 13/65915; H01R 12/596; H01R 12/75; H01R 13/514; H01R 13/6461; H01R 13/6582; H01R 12/775

See application file for complete search history.

(56) References Cited

U.S. PATENT DOCUMENTS

| | | | | |
|---|---|---|---|---|
| 5,030,138 | A | 7/1991 | Capp et al. | |
| 8,475,208 | B2 | 7/2013 | Simpson et al. | |
| 8,791,366 | B2 * | 7/2014 | Nonen | H01R 13/65915 174/113 R |
| 9,178,287 | B2 * | 11/2015 | Tanaka | H01R 13/65914 |
| 9,735,495 | B2 * | 8/2017 | Gross | H01R 13/5208 |
| 9,774,113 | B2 * | 9/2017 | Zhang | H01R 12/62 |
| 10,170,862 | B2 * | 1/2019 | Weidner | H01R 13/6594 |
| 11,228,145 | B2 * | 1/2022 | Maesoba | H01R 13/6585 |
| 2018/0337483 | A1 * | 11/2018 | Henry | H01R 13/6471 |
| 2019/0140374 | A1 * | 5/2019 | Wu | H01R 12/53 |
| 2022/0238254 | A1 * | 7/2022 | Gundel | H01B 11/005 |

* cited by examiner

*Primary Examiner* — Truc T Nguyen

(57) ABSTRACT

A contact assembly includes a leadframe having signal contacts and ground contacts including intermediate portions extends between mating ends and terminating ends. The contact assembly includes a contact holder holding the intermediate portions. The contact assembly includes cables terminated to the leadframe having signal conductors held by insulators and ground shields surrounding the signal conductors to provide electrical shielding and drain wires electrically connected to the ground shields. The signal conductors are terminated to terminating ends of corresponding signal contacts. The drain wires are terminated to terminating ends of ground contacts to electrically common the ground shields and the ground contacts of the leadframe. The contact assembly includes a ground bus separate and discrete from the leadframe terminated to each of the ground contacts to electrically common the ground contacts.

20 Claims, 5 Drawing Sheets

CONTACT ASSEMBLY WITH GROUND STRUCTURE

BACKGROUND OF THE INVENTION

The subject matter herein relates generally to electrical connectors.

Electrical connectors are typically used to electrically couple various types of electrical devices to transmit signals between the devices. At least some known electrical connectors include a cable assembly having cables connected between the electrical device and the electrical connector. The cables each have a signal conductor or a differential pair of signal conductors surrounded by a shield layer that, in turn, is surrounded by a cable jacket. The shield layer includes a conductive foil, which functions to shield the signal conductor(s) from electromagnetic interference (EMI) and generally improve performance. Some known cables include drain wires. Exposed portions of the conductor(s) are mechanically and electrically coupled (e.g., soldered) to corresponding elements of an electrical device. However, termination of the ground structure of the cable is problematic, leading to impedance mismatch and a reduction in the overall performance of the electrical connector.

Accordingly, there is a need for an electrical connector having improved an improved ground structure.

BRIEF DESCRIPTION OF THE INVENTION

In one embodiment, a contact assembly for an electrical connector is provided and includes a leadframe having an array of contacts including signal contacts and ground contacts. The ground contacts are interspersed with the signal contacts to provide electrical shielding between corresponding signal contacts. Each signal contact includes a signal intermediate portion extends between a signal mating end and a signal terminating end. Each ground contact includes a ground intermediate portion extends between a ground mating end and a ground terminating end. The contact assembly includes a contact holder holding the array of contacts. The contact holder is a dielectric material. The contact holder holds each of the signal intermediate portions and holds each of the ground intermediate portions. The signal mating ends and the ground mating ends extend forward of the contact holder. The signal terminating ends and the ground terminating ends extend rearward of the contact holder. The contact assembly includes cables terminated to the leadframe. The cables include signal conductors held by insulators and ground shields surrounding the corresponding signal conductors to provide electrical shielding for the signal conductors. The cables include drain wires held in outer jackets of the cables. The drain wires are electrically connected to the ground shields. The signal conductors are terminated to corresponding signal terminating ends. The drain wires are terminated to each of the ground terminating ends to electrically common the ground shields and the ground contacts of the leadframe. The contact assembly includes a ground bus separate and discrete from the leadframe. The ground bus is terminated to each of the ground contacts to electrically common the ground contacts.

In another embodiment, a contact assembly for an electrical connector is provided and includes a leadframe having an array of contacts including signal contacts and ground contacts. The ground contacts are interspersed with the signal contacts to provide electrical shielding between corresponding signal contacts. Each signal contact includes a signal intermediate portion extending between a signal mating end and a signal terminating end. Each ground contact includes a ground intermediate portion extending between a ground mating end and a ground terminating end. The contact assembly includes a contact holder holding the array of contacts. The contact holder is a dielectric material. The contact holder holds each of the signal intermediate portions and holds each of the ground intermediate portions. The signal mating ends and the ground mating ends extend forward of the contact holder. The signal terminating ends and the ground terminating ends extend rearward of the contact holder. The contact assembly includes cables terminated to the leadframe. Each cable includes first and second signal conductors held by an insulator and a ground shield surrounding the signal conductor to provide electrical shielding for the signal conductors. The cable includes a first drain wire at a first side of the cable and a second drain wire at a second side of the cable. The first and second drain wires are electrically connected to the ground shield. The first and second signal conductors are terminated to corresponding signal terminating ends. The first and second drain wires are terminated to the ground terminating ends of corresponding ground contacts to electrically common the ground shield and the ground contacts of the leadframe. The contact assembly includes a ground bus separate and discrete from the leadframe. The ground bus is terminated to each of the ground contacts to electrically common the ground contacts.

In a further embodiment, an electrical connector is provided and includes a housing having a cavity receiving an upper contact assembly and a lower contact assembly. The housing includes a card slot at a mating end of the housing configured to receive a card edge of a circuit card of a mating connector. The upper contact assembly includes an upper leadframe having an array of upper contacts including upper signal contacts and upper ground contacts. The upper ground contacts are interspersed with the upper signal contacts to provide electrical shielding between corresponding upper signal contacts. Each upper signal contact includes an upper signal intermediate portion extending between an upper signal mating end and an upper signal terminating end. Each upper ground contact includes an upper ground intermediate portion extends between an upper ground mating end and an upper ground terminating end. The upper contact assembly includes an upper contact holder holding the array of upper contacts. The upper contact holder is a dielectric material. The upper contact holder holds each of the upper signal intermediate portions and holds each of the upper ground intermediate portions. The upper signal mating ends and the upper ground mating ends extend forward of the contact holder. The upper signal terminating ends and the upper ground terminating ends extend rearward of the upper contact holder. The upper contact assembly includes upper cables terminated to the upper leadframe. The upper cables include upper signal conductors held by insulators and upper ground shields surrounding the corresponding upper signal conductors to provide electrical shielding for the upper signal conductors. The upper cables include upper drain wires electrically connected to the upper ground shields. The upper signal conductors are terminated to corresponding upper signal terminating ends. The upper drain wires are terminated to each of the upper ground terminating ends to electrically common the upper ground shields and the upper ground contacts of the upper leadframe. The upper contact assembly includes an upper ground bus separate and discrete from the upper leadframe. The upper ground bus is terminated to each of the upper ground contacts to electrically common the ground contacts. The lower contact assembly includes a lower leadframe having an array of lower contacts including lower signal contacts and lower ground contacts. The lower ground contacts are interspersed with the lower signal contacts to provide electrical shielding between corresponding lower signal contacts. Each lower signal contact includes a lower signal intermediate portion extending between a lower signal mating end and a lower signal terminating end. Each lower ground contact includes a lower ground intermediate portion extending between a lower ground mating end and a lower ground terminating end. The lower contact assembly includes a lower contact holder holding the array of lower contacts. The lower contact holder is a dielectric material. The lower contact holder holds each of the lower signal intermediate portions and holds each of the lower ground intermediate portions. The lower signal mating ends and the lower ground mating ends extend forward of the contact holder. The lower signal terminating ends and the lower ground terminating ends extend rearward of the lower contact holder. The lower contact assembly includes lower cables terminated to the lower leadframe. The lower cables include lower signal conductors held by insulators and lower ground shields surrounding the corresponding lower signal conductors to provide electrical shielding for the lower signal conductors. The lower cables include lower drain wires are electrically connected to the lower ground shields. The lower signal conductors are terminated to corresponding lower signal terminating ends. The lower drain wires are terminated to each of the lower ground terminating ends to electrically common the lower ground shields and the lower ground contacts of the lower leadframe. The lower contact assembly includes a lower ground bus separate and discrete from the lower leadframe. The lower ground bus are terminated to each of the lower ground contacts to electrically common the ground contacts.

DETAILED DESCRIPTION OF THE INVENTION

Figure 1:
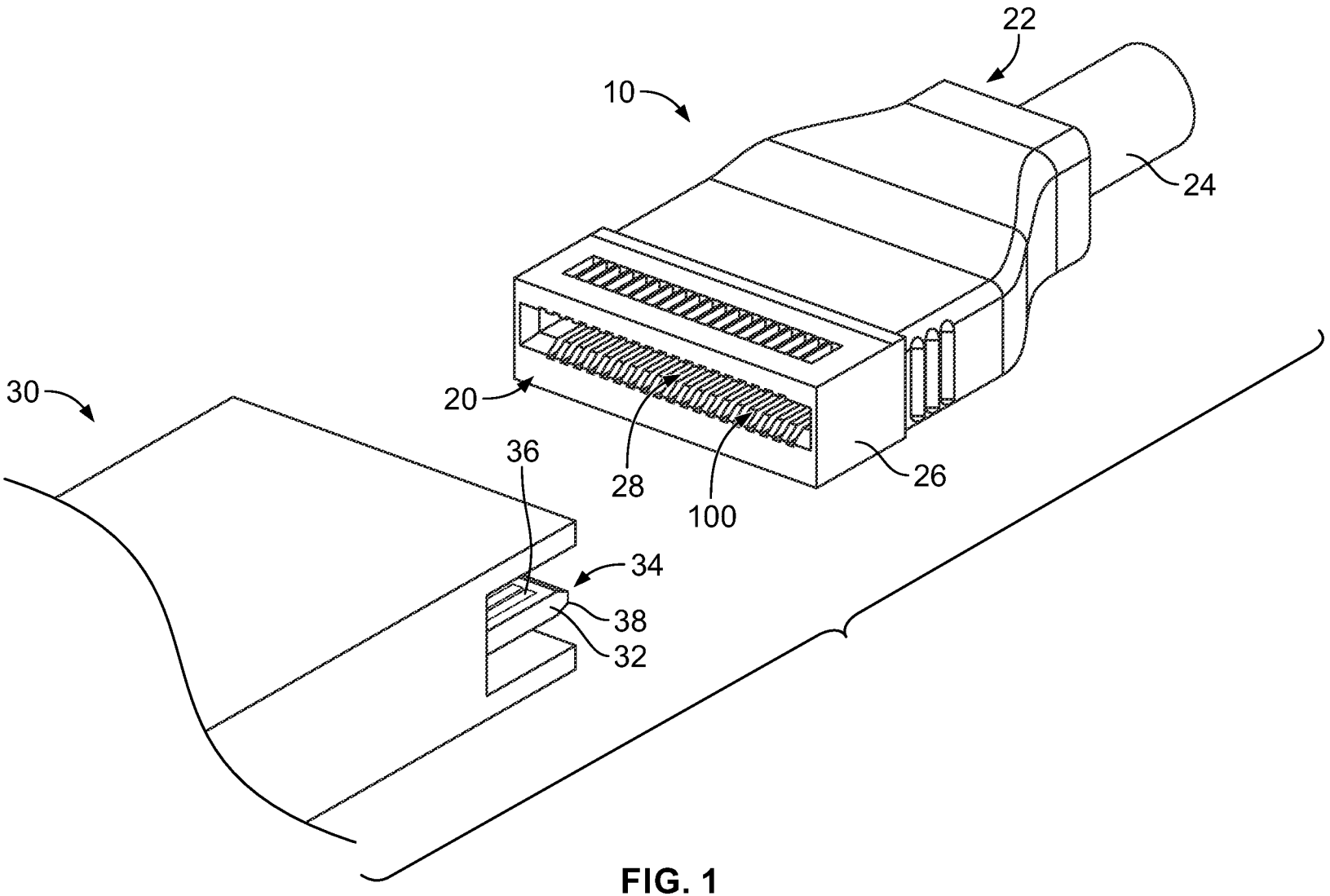
FIG. 1 is a perspective view of an electrical connector formed in accordance with one embodiment.

FIG. 1 is a perspective view of an electrical connector 10 formed in accordance with one embodiment. The electrical connector 10 is configured to be mated with a mating electrical connector 30. In an exemplary embodiment, the electrical connector 10 has a mating end 20, a cable end 22, and one or more cables 24 extending from the cable end 22. The electrical connector 10 includes a housing 26 configured to hold a contact assembly 100. In an exemplary embodiment, the housing 26 includes a card slot 28 at the mating end 20. In the illustrated embodiment, the electrical connector 10 is a communication device, such as a serial attached SCSI (SAS) connector. However, the electrical connector 10 may be another type of electrical connector in an alternative embodiment. For example, the electrical connector 10 may define a socket or receptacle connector, such as a card edge socket connector.

The mating electrical connector 30 is configured to be mated with the electrical connector 10. In an exemplary embodiment, the mating electrical connector 30 has a circuit card 32 at a mating end 34 of the mating electrical connector 30. The circuit card 32 includes mating contacts 36 at a card edge 38 of the circuit card 32. The connectors 10, 30 may be a high-speed connectors that transmit data signals at speeds over 10 gigabits per second (Gbps), such as over 25 Gbps. The connectors 10, 30 may be input-output (I/O) connectors.

Figure 2:
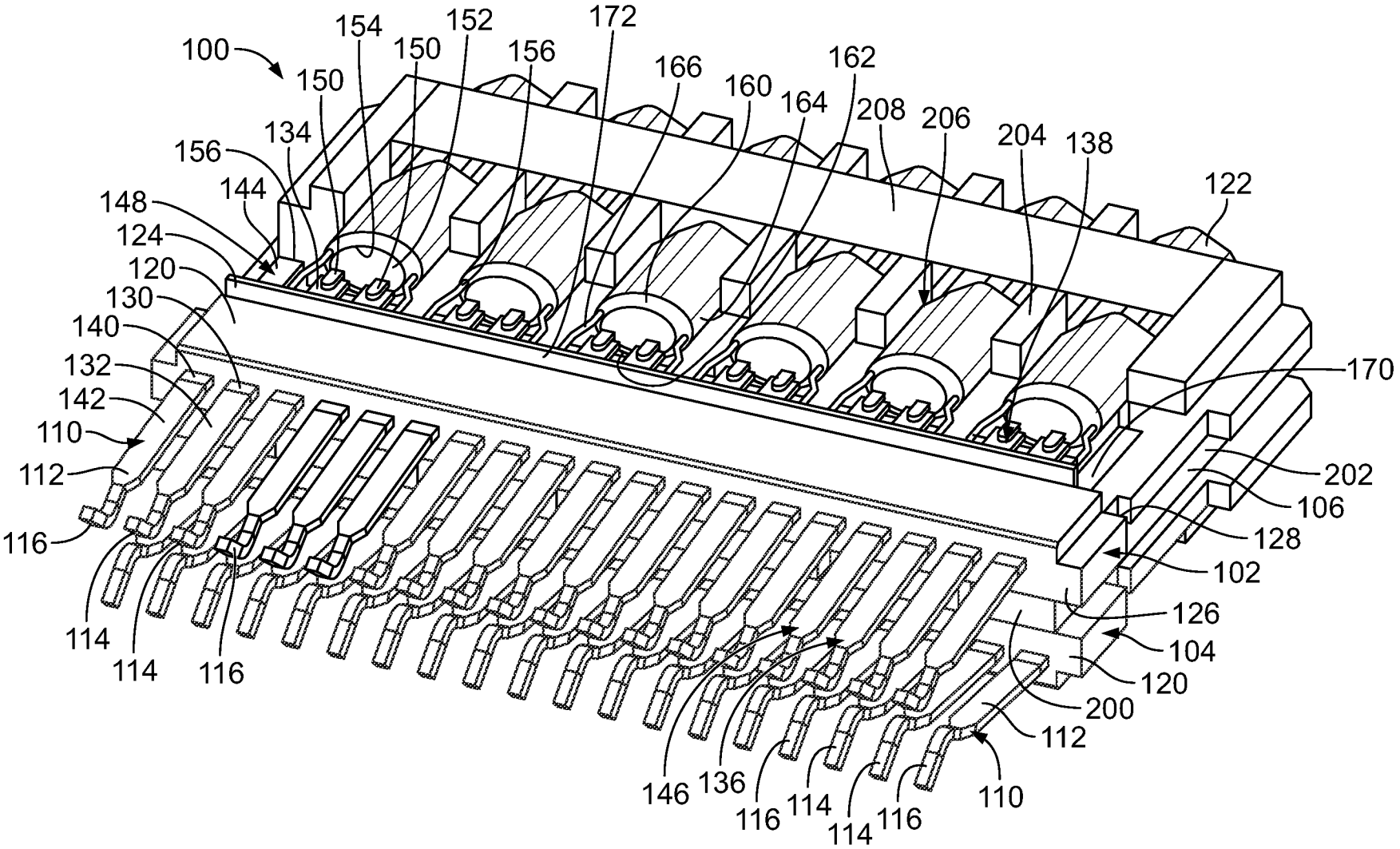
FIG. 2 is a perspective view of a contact assembly of the electrical connector formed in accordance with one embodiment.

FIG. 2 is a perspective view of the contact assembly 100 formed in accordance with one embodiment. In an exemplary embodiment, the contact assembly 100 includes an upper contact subassembly 102 and a lower contact subassembly 104 coupled to a frame 106. The frame 106 supports the upper and lower contact subassemblies 102, 104. Optionally, the upper and lower contact subassemblies 102, 104 may be identical to each other and inverted 180°. In alternative embodiments, the contact assembly 100 may be provided without the frame 106, rather having the upper and lower contact assemblies coupled directly to each other without an intervening supporting structure. In other alternative embodiments, the contact assembly 100 may be provided with a single contact subassembly, such as provided without the lower contact subassembly 104.

The description herein may be made specifically to the "upper" contact subassembly 102 with the qualifier "upper" and may be made specifically to the "lower" contact subassembly 104 with the qualifier "lower" or may be made generically to the upper or the lower contact subassemblies 102, 104 without use of the qualifiers "upper" or "lower".

The contact assembly 100 includes a leadframe 110 having an array of contacts 112 including signal contacts 114 and ground contacts 116. The contact assembly 100 includes a contact holder 120 holding the array of contacts 112. The contact assembly 100 includes cables 122 terminated to the leadframe 110. The contact assembly 100 includes a ground bus 124 provided to electrically common the ground contacts 116 and the cables 122.

In an exemplary embodiment, the cables 122 are twinaxial cables. Each cable 122 include a pair of signal conductors 150 arranged in an insulator 152. A cable shield 154 surrounds the insulator 152 to provide electrical shielding for the signal conductors 150. The cable 122 includes one or more drain wires 156 electrically connected to the cable shield 154. In an exemplary embodiment, the cable 122 includes a pair of drain wires 156, such as arranged at opposite sides of the cable 122. In an exemplary embodiment, the cable 122 is oval shaped, such as being obround or racetrack shaped. For example, the cable 122 includes opposite first and second ends 160, 162 that are generally parallel to each other and opposite first and second sides 164, 166 that extend between the first and second ends 160, 162. The first and second sides 164, 166 are curved, such as being semi-circular. The first and second ends 160, 162 may be flat. In the illustrated embodiment, the drain wires 156 are provided at the first and second sides 164, 166.

The contact holder 120 is used to hold the contacts 112, including the signal contacts 114 and the ground contacts 116. The contact holder 120 is manufactured from a dielectric material to electrically isolate the contacts 112 from each other. In an exemplary embodiment, the contact holder 120 is overmolded over the leadframe 110 to encase portions of the contacts 112 and hold relative positions of the contacts 112. The contact holder 120 extends between a front 126 and a rear 128.

In an exemplary embodiment, the contacts 112 are arranged in one or more rows. For example, the upper contacts 112 are arranged in an upper row configured to interface with an upper surface of a circuit card, such as the circuit card 32, and the lower contacts 112 are arranged in a lower row configured to interface with a lower surface of the circuit card 32. In an exemplary embodiment, the signal contacts 114 are arranged in pairs, such as differential pairs. The ground contacts 116 are interspersed between the signal contacts 114, such as between the pairs of the signal contacts 114, to provide electrical shielding between the corresponding signal contacts 114.

Each signal contact 114 includes a signal intermediate portion 130 extending between a signal mating end 132 and a signal terminating end 134. The contact holder 120 holds the signal intermediate portions 130 relative to each other. The contact holder 120 maintains spacing between the signal contacts 114. The signal mating ends 132 are located forward of the contact holder 120. The signal terminating ends 134 are located rearward of the contact holder 120. In an exemplary embodiment, the signal contacts 114 include spring beams 136 at the signal mating ends 132. The spring beams 136 are deflectable spring beams. The spring beams 136 include separable mating interfaces at or near the distal ends of the spring beams 136. The spring beams 136 may be curved or cupped at the distal ends to prevent stubbing during mating with the circuit card. In an exemplary embodiment, the signal contacts 114 include weld pads 138 at the signal terminating ends 134. The weld pads 138 are configured to be welded to the signal conductors 150 (also shown in FIGS. 3 and 4) of the cables 122.

Each ground contact 116 includes a ground intermediate portion 140 extending between a ground mating end 142 and a ground terminating end 144. The contact holder 120 holds the ground intermediate portions 140 relative to each other and relative to the signal intermediate portions 130. The ground mating ends 142 are located forward of the contact holder 120. The ground terminating ends 144 are located rearward of the contact holder 120. In an exemplary embodiment, the ground contacts 116 include spring beams 146 at the ground mating ends 142. The spring beams 146 are deflectable spring beams. The spring beams 146 include separable mating interfaces at or near the distal ends of the spring beams 146. The spring beams 146 may be curved or cupped at the distal ends to prevent stubbing during mating with the circuit card. In an exemplary embodiment, the ground contacts 116 include weld pads 148 at the ground terminating ends 144. The weld pads 148 are configured to be welded to the drain wires 156 (also shown in FIGS. 3 and 4) of the cables 122 to electrically common the cables 122 and the leadframe 110. The ground bus 124 electrically commons each of the ground contacts 116 with each other. The drain wires 156, the cable shields 154 (also shown in FIGS. 3 and 4), the ground contacts 116 and the ground bus 124 form a ground structure 158 of the electrical connector 10.

During assembly, the upper and lower contact subassemblies 102, 104 are coupled to the frame 106. The frame 106 includes a platform 200 at a front of the frame 106. The upper and lower contact holders 120 are coupled to the platform 200, such as to upper and lower surfaces of the platform 200, respectively. The frame 106 includes a cable support tray 202 rearward of the platform 200. The cable support tray 202 supports the cables 122, such as along upper and lower surfaces of the cable support tray 202. The cable support tray 202 includes separating walls 204 forming cable channels 206 that receive corresponding cables 122. In an exemplary embodiment, the frame 106 includes a strain relief element 208 (shown in cross section) providing strain relief for the cables 122. The strain relief element 208 is coupled to the cable support tray 202. The strain relief element 208 may extend to cover the ends of the cables 122 and may cover portions of the leadframe 110, such as the interface between the cables 122 and the leadframe 110. During assembly, the cables 122 are received in the cable channels 206 and terminated to the leadframe 110. Signal conductors 150 of the cables 122 are terminated to the signal contacts 114. The drain wires 156 are electrically connected to the ground contacts 116. The strain relief element 208 may cover the signal conductors 150 and the drain wires 156.

The ground bus 124 is separate and discrete from the leadframe 110. Both the ground bus 124 and the leadframe 110 are electrically connected to the cable shields 154 of the cables 122 via the drain wires 156 to electrically common the cables 122 and the ground contacts 116. The ground bus 124 includes ground fingers 170 and a connecting beam 172 between the ground fingers 170. The ground fingers 170 are aligned with and coupled to the corresponding ground contacts 116. The connecting beam 172 extends between the ground fingers 170. The connecting beam 172 mechanically and electrically connects the ground fingers 170. The ground bus 124 electrically commons each of the ground contacts 116.

Figure 3:
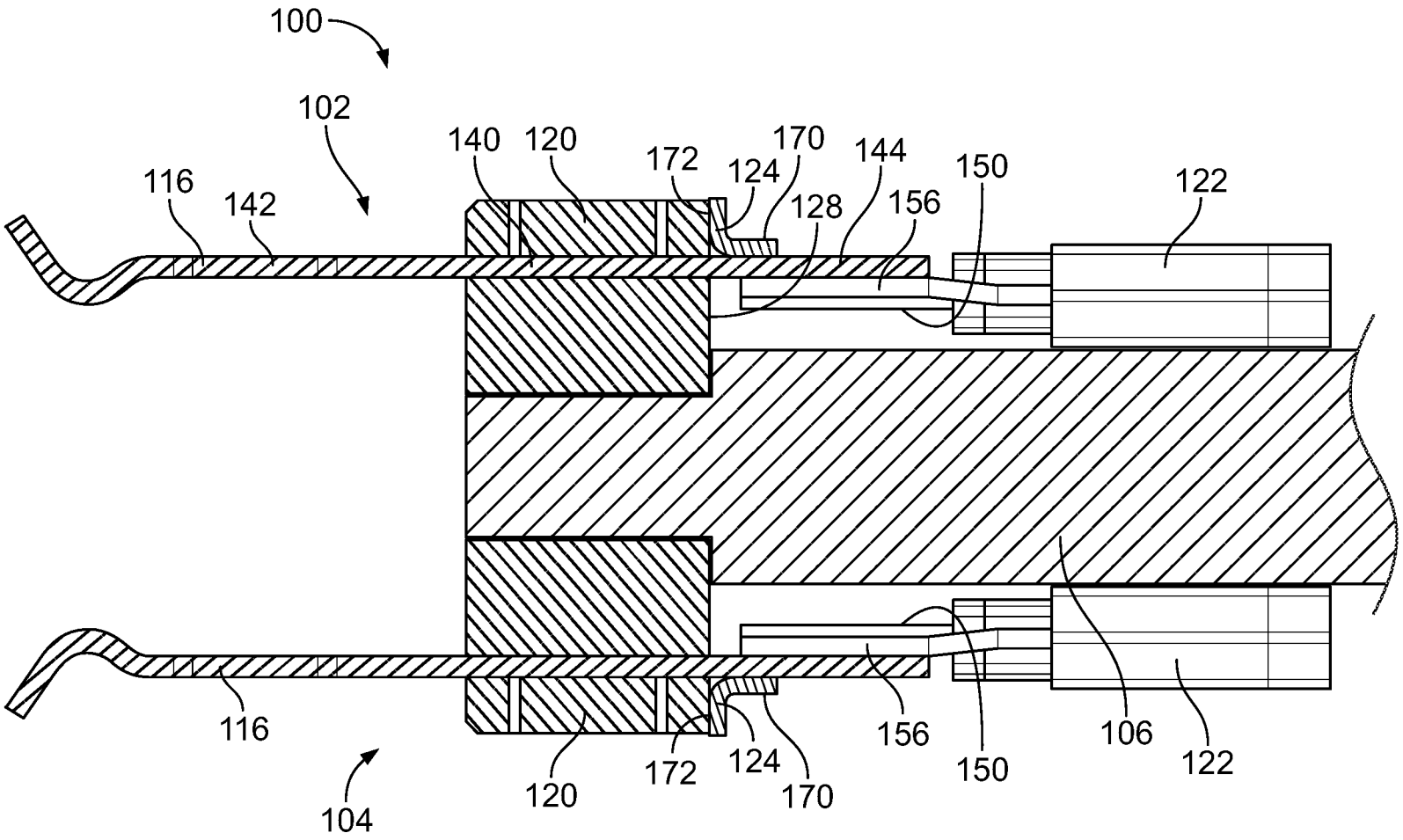
FIG. 3 is a side view of the contact assembly in accordance with an exemplary embodiment.

FIG. 3 is a side view of the contact assembly 100 in accordance with an exemplary embodiment. FIG. 3 illustrates the upper and lower contact subassemblies 102, 104 coupled to the frame 106. The contact holders 120 are coupled to the frame 106. The upper signal contacts 114 and the upper ground contacts 116 are aligned with each other in an upper row and the lower signal contacts 114 and the lower ground contacts 116 are aligned with each other in a lower row. For example, the signal and ground mating ends 132, 142 are aligned with each other. The signal and ground intermediate portions 130, 140 are aligned with each other. In the illustrated embodiment, the upper signal conductors 150 extend along lower surfaces of the upper signal contacts 114 and the lower signal conductors 150 extend along upper surfaces of the lower signal contacts 114. In the illustrated embodiment, the upper drain wires 156 extend along the lower surfaces of the upper signal contacts 114 and the lower drain wires 156 extend along upper surfaces of the lower signal contacts 114.

In an exemplary embodiment, the upper ground bus 124 is coupled to an upper surface of the upper ground contact 116 and the lower ground bus 124 is coupled to a lower surface of the lower ground contact 116. The ground buses 124 may be located remote from distal ends of the ground contacts 116, such as proximate to the contact holder 120. Optionally, the ground buses 124 may be coupled to the ground intermediate portions 140. The connecting beams 172 may abut against the rears 128 of the contact holders 120. In the illustrated embodiment, the ground buses 124 are L-shaped with the ground fingers 170 extending perpendicular to the connecting beams 172. The ground finger 170 is electrically coupled to the ground contact 116. For example, the ground finger 170 may be welded to the ground contact 116.

Figure 4:
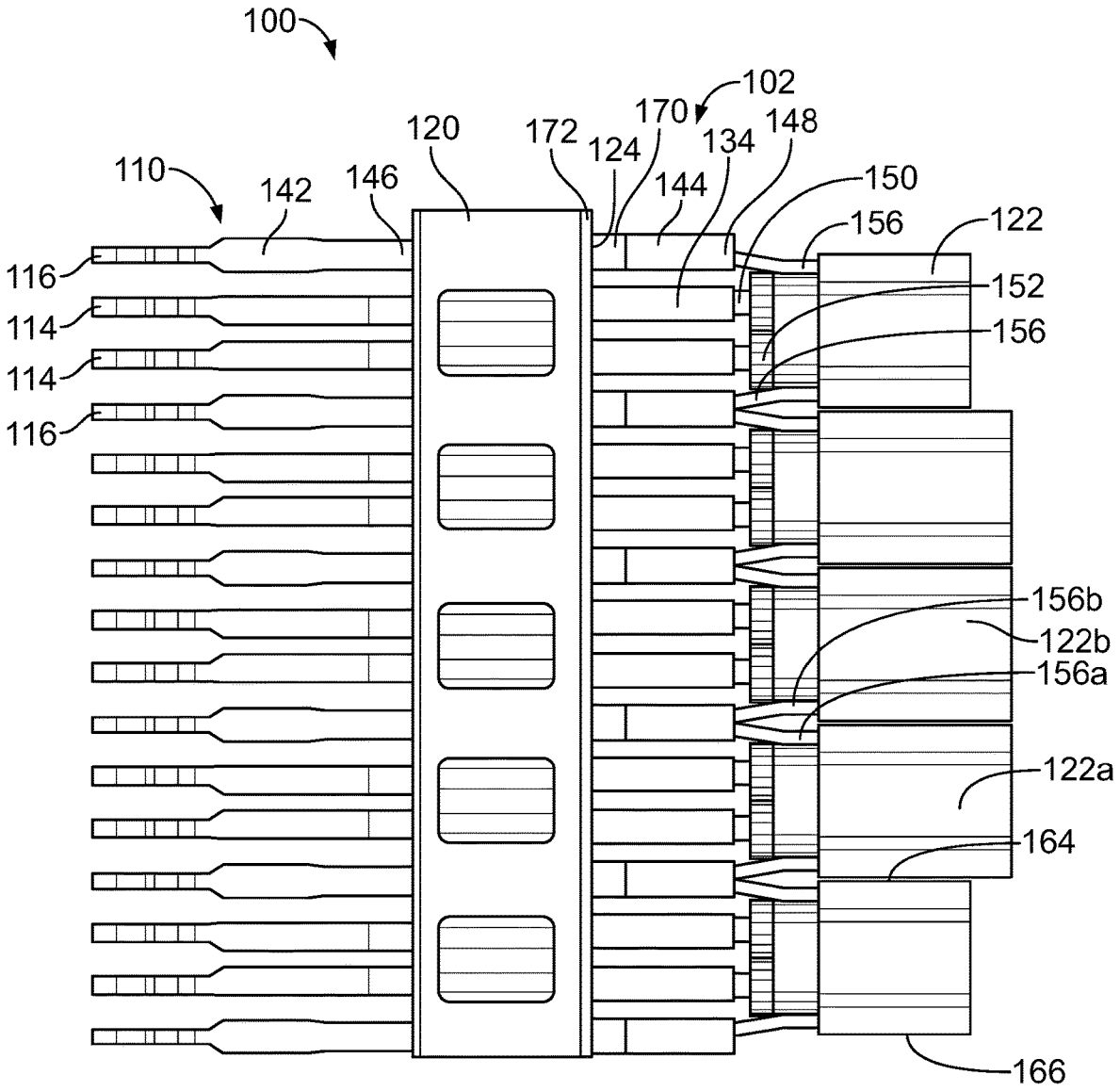
FIG. 4 is a top view of a portion of the contact assembly showing in accordance with an exemplary embodiment.
Figure 5:
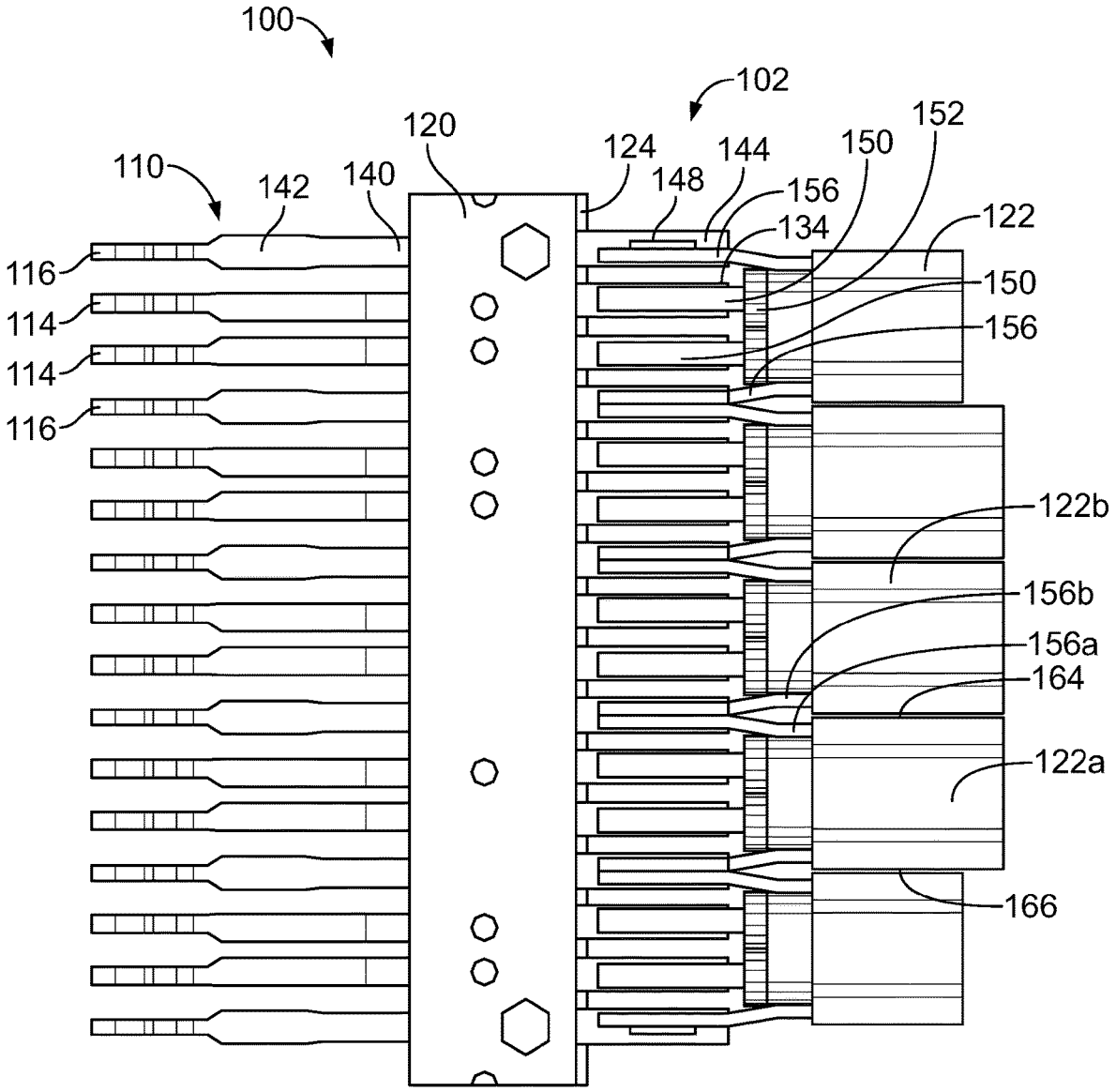
FIG. 5 is a bottom view of a portion of the contact assembly showing in accordance with an exemplary embodiment.

FIG. 4 is a top view of a portion of the contact assembly 100 showing the upper contact assembly 102 in accordance with an exemplary embodiment. FIG. 5 is a bottom view of a portion of the contact assembly 100 showing the upper contact assembly 102 in accordance with an exemplary embodiment. The lower contact assembly 104 (shown in FIG. 3) may be similar to the upper contact assembly 102, such as being inverted relative to the upper contact assembly 102.

The contact holder 120 holds the signal and ground contacts 114, 116 relative to each other. The signal terminating ends 134 extend rearward from the contact holder 120 for termination to the signal conductors (FIG. 5). The ground terminating ends 144 extend rearward from the contact holder 120 for termination to the drain wires 156 (FIG. 5) and the ground bus 124 (FIG. 4). The ground fingers 170 of the ground bus 124 are coupled to the ground contacts 116. For example, the ground fingers 170 are welded to the upper surfaces of the ground contacts 116 to mechanically and electrically connect the ground bus 124 to the leadframe 110.

In an exemplary embodiment, the end of the cable 122 is stripped to expose ends of the signal conductors 150 and ends of the drain wires 156. The signal conductors 150 extend forward from the end of the insulator 152 for termination to the signal terminating ends 134. For example, the signal conductors 150 may be welded to the signal terminating ends 134. In an exemplary embodiment, the signal conductors 150 extend longitudinally, such as along straight paths from the insulator 152 for termination to the signal contacts 114. The signal contacts 114, within the leadframe 110, have a pitch or spacing the corresponds to the pith or spacing of the signal conductors 150 to eliminate the need for bending or manipulating the signal paths, which could negatively affect the signal integrity of the electrical connector 10.

The drain wires 156 extend forward from the end of the insulator 152 for termination to the ground terminating ends 144. For example, the drain wires 156 may extend from both sides 164, 166 of the cable 122. The drain wires 156 may be welded to the ground terminating ends 144. In an exemplary embodiment, the drain wires 156 extend longitudinally, such as along generally straight paths from the end of the insulator 152 for termination to the ground contacts 116. Optionally, the drain wires 156 may be stepped outward to align with the ground contact 116 based on the pitch of the contacts of the leadframe 110. The ground paths thus extend along longitudinal paths from the ground mating ends 142, through the ground intermediate portions 140, the ground terminating ends 144 and the drain wires 156, into the cables 122. The drain wires 156 are located between the signal conductors 150 to provide electrical shielding between the pairs of signal conductors 150, such as at the mating interfaces, which reduces cross talk and improves signal integrity of the electrical connector 10. The forwardly extending ground paths reduce reflections to improve electrical characteristics of the electrical connector 10, such as compared to conventional electrical connectors having drain wires that are folded over and looped 180° to connect to a bus bar extending along the top of the cables.

In an exemplary embodiment, the drain wires 156 of adjacent cables 122 are combined and joined to common ground contacts 116. For example, the right drain wire 156*a* of one cable 122*a* is combined with the left drain wire 156*b* of another, adjacent cable 122*b*. The right and left drain wires 156*a*, 156*b* are both welded to the same ground contact 116. The weld pad 148 is wide enough to accommodate both drain wires 156*a*, 156*b*.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A contact assembly for an electrical connector comprising:

a leadframe having an array of contacts including signal contacts and ground contacts, the ground contacts interspersed with the signal contacts to provide electrical shielding between corresponding signal contacts, each signal contact including a signal intermediate portion extending between a signal mating end and a signal terminating end, each ground contact including a ground intermediate portion extending between a ground mating end and a ground terminating end;

a contact holder holding the array of contacts, the contact holder being a dielectric material, the contact holder holding each of the signal intermediate portions and holding each of the ground intermediate portions, the signal mating ends and the ground mating ends extending forward of the contact holder, the signal terminating ends and the ground terminating ends extending rearward of the contact holder;

cables terminated to the leadframe, the cables including signal conductors held by insulators and ground shields surrounding the corresponding signal conductors to provide electrical shielding for the signal conductors, the cables including drain wires held in outer jackets of the cables, the drain wires being electrically connected to the ground shields, the signal conductors being terminated to corresponding signal terminating ends, the drain wires extending forward from the corresponding insulator along the ground terminating end of the corresponding ground contact and being terminated to each of the ground terminating ends to electrically common the ground shields and the ground contacts of the leadframe; and a ground bus separate and discrete from the leadframe, the ground bus being terminated to each of the ground contacts to electrically common the ground contacts.

2. The contact assembly of claim 1, wherein the drain wires extend forward of the insulator for termination to the ground terminating ends of the ground contacts.

3. The contact assembly of claim 1, wherein each cable is obround having first and second ends being parallel to each other and first and second sides opposite each other extending between the first and second ends, the drain wire positioned at the first side.

4. The contact assembly of claim 3, wherein the cable includes a second drain wire at the second side, the drain wire being terminated to a first ground contact of the ground contacts, the second drain wire being terminated to a second ground contact of the ground contacts.

5. The contact assembly of claim 1, wherein each cable extends along a longitudinal axis, the drain wires extend longitudinally from the end of the cable to interface with the corresponding ground contact.

6. The contact assembly of claim 1, wherein the ground bus is located forward of the ground terminating ends.

7. The contact assembly of claim 1, wherein the ground bus includes ground fingers and a connecting beam extending between the ground fingers, the ground fingers being aligned with and welded to the corresponding ground contacts, the connecting beam mechanically and electrically connected to ground fingers.

8. The contact assembly of claim 1, further comprising a strain relief element encasing portions of the signal terminating ends, the ground terminating ends, the drain wires and the ground bus.

9. The contact assembly of claim 1, wherein the signal mating ends and the ground mating ends are aligned with each other in a single row, the signal intermediate portions and the ground intermediate portions are aligned with each other in a single row and wherein the signal terminating ends are aligned with each other in a single row, the drain wires and the conductors being aligned with each other in a single row.

10. The contact assembly of claim 1, wherein the signal mating end of each signal contact includes a spring beam including a separable interface configured to be electrically connected to a mating signal contact of a mating connector, and wherein the ground mating end of each ground contact includes a spring beam including a separable interface configured to be electrically connected to a mating ground contact of the mating connector.

11. The contact assembly of claim 1, wherein the signal terminating end of each signal contact includes a weld tab being welded to the signal conductor of the corresponding cable and wherein the ground terminating end of each ground contact includes a weld tab being welded to the drain wire of the corresponding cable.

12. A contact assembly for an electrical connector comprising:

a leadframe having an array of contacts including signal contacts and ground contacts, the ground contacts interspersed with the signal contacts to provide electrical shielding between corresponding signal contacts, each signal contact including a signal intermediate portion extending between a signal mating end and a signal terminating end, each ground contact including a ground intermediate portion extending between a ground mating end and a ground terminating end;

a contact holder holding the array of contacts, the contact holder being a dielectric material, the contact holder holding each of the signal intermediate portions and holding each of the ground intermediate portions, the signal mating ends and the ground mating ends extending forward of the contact holder, the signal terminating ends and the ground terminating ends extending rearward of the contact holder;

cables terminated to the leadframe, each cable including first and second signal conductors held by an insulator and a ground shield surrounding the signal conductor to provide electrical shielding for the signal conductors, the cable including a first drain wire at a first side of the cable and a second drain wire at a second side of the cable, the first and second drain wires being electrically connected to the ground shield, the first and second signal conductors being terminated to corresponding signal terminating ends, the first and second drain wires being terminated to the ground terminating ends of corresponding ground contacts to electrically common the ground shield and the ground contacts of the leadframe; and a ground bus separate and discrete from the leadframe, the ground bus being terminated to each of the ground contacts to electrically common the ground contacts.

13. The contact assembly of claim 12, wherein the first and second drain wires extend forward of the insulator for termination to the ground terminating ends of the ground contacts.

14. The contact assembly of claim 12, wherein the cable is obround having first and second ends being parallel to each other and first and second sides opposite each other extending between the first and second ends, the first drain wire positioned at the first side, the second drain wire positioned at the second side, the first and second drain wires being terminated to different ground contacts.

15. The contact assembly of claim 12, wherein the cable extends along a longitudinal axis, the first and second drain wires extend longitudinally forward from the insulator of the cable to interface with the corresponding ground contact.

16. The contact assembly of claim 12, wherein the ground bus is located forward of the ground terminating ends.

17. The contact assembly of claim 12, wherein the ground bus includes ground fingers and a connecting beam extending between the ground fingers, the ground fingers being aligned with and welded to the corresponding ground contacts, the connecting beam mechanically and electrically connected to ground fingers.

18. An electrical connector comprising:

a housing having a cavity receiving an upper contact assembly and a lower contact assembly, the housing including a card slot at a mating end of the housing configured to receive a card edge of a circuit card of a mating connector;

the upper contact assembly comprising:

an upper leadframe having an array of upper contacts including upper signal contacts and upper ground contacts, the upper ground contacts interspersed with the upper signal contacts to provide electrical shielding between corresponding upper signal contacts, each upper signal contact including an upper signal intermediate portion extending between an upper signal mating end and an upper signal terminating end, each upper ground contact including an upper ground intermediate portion extending between an upper ground mating end and an upper ground terminating end;

an upper contact holder holding the array of upper contacts, the upper contact holder being a dielectric material, the upper contact holder holding each of the upper signal intermediate portions and holding each of the upper ground intermediate portions, the upper signal mating ends and the upper ground mating ends extending forward of the contact holder, the upper signal terminating ends and the upper ground terminating ends extending rearward of the upper contact holder;

upper cables terminated to the upper leadframe, the upper cables including upper signal conductors held by insulators and upper ground shields surrounding the corresponding upper signal conductors to provide electrical shielding for the upper signal conductors, the upper cables including upper drain wires being electrically connected to the upper ground shields, the upper signal conductors being terminated to corresponding upper signal terminating ends, the upper drain wires extending forward from the corresponding insulator along the upper ground terminating end of the corresponding upper ground contact and being terminated to each of the upper ground terminating ends to electrically common the upper ground shields and the upper ground contacts of the upper leadframe; and an upper ground bus separate and discrete from the upper leadframe, the upper ground bus being terminated to each of the upper ground contacts to electrically common the ground contacts;

the lower contact assembly comprising:

a lower leadframe having an array of lower contacts including lower signal contacts and lower ground contacts, the lower ground contacts interspersed with the lower signal contacts to provide electrical shielding between corresponding lower signal contacts, each lower signal contact including a lower signal intermediate portion extending between a lower signal mating end and a lower signal terminating end, each lower ground contact including a lower ground intermediate portion extending between a lower ground mating end and a lower ground terminating end;

a lower contact holder holding the array of lower contacts, the lower contact holder being a dielectric material, the lower contact holder holding each of the lower signal intermediate portions and holding each of the lower ground intermediate portions, the lower signal mating ends and the lower ground mating ends extending forward of the contact holder, the lower signal terminating ends and the lower ground terminating ends extending rearward of the lower contact holder;

lower cables terminated to the lower leadframe, the lower cables including lower signal conductors held by insulators and lower ground shields surrounding the corresponding lower signal conductors to provide electrical shielding for the lower signal conductors, the lower cables including lower drain wires being electrically connected to the lower ground shields, the lower signal conductors being terminated to corresponding lower signal terminating ends, the lower drain wires extending forward from the corresponding insulator along the lower ground terminating end of the corresponding lower ground contact and being terminated to each of the lower ground terminating ends to electrically common the lower ground shields and the lower ground contacts of the lower leadframe; and a lower ground bus separate and discrete from the lower leadframe, the lower ground bus being terminated to each of the lower ground contacts to electrically common the ground contacts.

19. The electrical connector of claim 18, wherein the upper drain wires extend to distal ends and the lower drain wires extend to distal ends, the upper drain wires extending generally parallel to the lower drain wires to the distal ends.

20. The electrical connector of claim 18, wherein the upper signal conductors extend along upper surfaces of the upper signal contacts and the upper drain wires extend along upper surfaces of the upper signal contacts, and wherein the lower signal conductors extend along lower surfaces of the lower signal contacts and the lower drain wires extend along lower surfaces of the upper signal contacts.

* * * * *